United States Patent [19]

Carney

[11] Patent Number: 4,634,178

[45] Date of Patent: Jan. 6, 1987

[54] ADAPTABLE SEATING DEVICE

[76] Inventor: Steven H. Carney, Rte. 2, Box 542K, Golden, Colo. 80401

[21] Appl. No.: 680,131

[22] Filed: Dec. 10, 1984

[51] Int. Cl.[4] ..... A47C 3/00

[52] U.S. Cl. ..... 297/284; 297/460

[58] Field of Search ..... 297/284, 460

[56] References Cited

U.S. PATENT DOCUMENTS

| | | | |
|---|---|---|---|
| 293,833 | 2/1884 | Winchester | 297/284 |
| 514,189 | 2/1894 | Harvey et al. | 297/284 |
| 1,228,771 | 6/1917 | Hanger | 297/284 |
| 1,789,821 | 1/1931 | Leffingwell | 297/284 |
| 2,550,831 | 5/1951 | Lingenfelter . | |
| 2,756,809 | 7/1956 | Endresen | 297/284 |
| 2,894,565 | 7/1959 | Conner . | |
| 3,106,423 | 10/1963 | Schwarz . | |
| 3,121,592 | 2/1964 | Anderson . | |
| 3,123,396 | 3/1964 | Searle | 297/284 |
| 3,762,769 | 10/1973 | Poschl | 297/284 |
| 3,880,463 | 4/1975 | Shephard et al. . | |
| 4,222,607 | 9/1980 | Dimmock . | |
| 4,239,282 | 12/1980 | White . | |
| 4,321,044 | 3/1982 | Kron | 297/284 |
| 4,350,388 | 9/1982 | Weiner | 297/284 |
| 4,502,728 | 3/1985 | Sheldon et al. | 297/284 |

*Primary Examiner*—Francis K. Zugel

*Attorney, Agent, or Firm*—Robert E. Harris

[57] ABSTRACT

An adaptable seating assembly is disclosed which is adjustable to varying body sizes and types. The seating device includes a backrest framework and a reference surface engaging seat framework, with the frameworks being joined to one another at one edge of each. The backrest framework extends outwardly from the seat framework a greater distance than does the seat framework from the backrest framework, a neck and shoulder support and an adjustable lumbar support are mounted within the backrest framework, and cushions are positioned at the backrest and seat frameworks so that the cushions are between each framework and a user when the user is seated in the seating assembly, when so seated, the natural curvature of the spine of a user is accomodated, and the lumbar region of the spine has a substantial number of the vertibrae thereof supported by the adjustable lumbar support.

4 Claims, 6 Drawing Figures

ADAPTABLE SEATING DEVICE

FIELD OF THE INVENTION

This invention relates to seating devices and, more particularly, relates to seating devices, such as chairs and the like, which are user adjustable.

BACKGROUND OF THE INVENTION

Adjustable seating devices with means for adjustment to the lumbar region of a particular user are well known. One conventional device of this type employs a rounded or otherwise raised lumbar supporting portion, for example those devices disclosed in U.S. Pat. Nos. 4,222,607, 4,350,388, 3,106,423, and 2,550,831. Such devices, however, not known to applicant, require that such adjustments be made before being seated in the device.

Another variety of seating device of this type discloses a pivot and gearing mechanism for causing adjustment of the lumbar supporting portion in a direction toward and away from the lumbar spine of a user. Some examples of this type are shown in U.S. Pat. Nos. 3,121,592, 3,106,423, and 3,880,463. Several such devices also are shown to reside on a pivot so that the lumbar support may be rotated within the backrest of a seating device, for example those devices shown in U.S. Pat. Nos. 4,222,607 and 4,239,282.

Other devices are shown to maintain lumbar supporting means within a backrest with wheel and track mechanisms or guide and ratchet mechanisms employed for adjustability, and some examples of which are shown in U.S. Pat. Nos. 4,239,282 and 3,762,769. A number of the devices, some of which are mentioned above, show a mounting surface for the lumbar support means which is a substantially solid and unbroken plane, for example those shown in U.S. Pat. Nos. 4,350,388, 3,121,592, and 2,894,565.

Thus, while seating devices with an adjustable supporting means and the like have heretofore been suggested and/or utilized, further improvements, as suggested herein, could nevertheless be utilized.

SUMMARY OF THE INVENTION

This invention provides an adaptable seating device capable of both adapting to the body of a user and being adjustable by a user while seated in the device. Overall, the device includes a framework having a seat section with a backrest section which is substantially open and having provided therein a lumbar supporting means which is adjustable and which presents a substantially flat surface to the lumbar region of the spine of a user, and a cushion positioned between backrest section, the lumbar supporting means, and a user when the user is seated in the seating device.

It is therefore an object of this invention to provide an improved seating device with back supporting sections which are both body adaptable and adjustable.

It is another object of this invention to provide an adjustable lumbar supporting means for use within a seating device which presents a substantially flat surface to the lumbar region of the spine of a user, thereby supporting a substantial portion of the lumbar region of the spine.

It is still another object of this invention to provide an improved seating device with backrest and seating section which are united at an angle obtuse to one another, and with a lumbar supporting portion within the backrest section which resides at an angle even more obtuse to the seating section than does the backrest section.

It is yet another object of this invention to provide an improved seating device with a backrest section which is substantially open and which provides a lumbar supporting section therein so that when the backrest section is cushioned the natural curvature of the spine of a user is accomodated by cooperation between the open backrest section and the lumbar supporting section.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings, in combination with the specification, illustrate complete embodiments of the invention according to the best mode so far devised for the practical application of the principles thereof, and in which.

DETAILED DESCRIPTION OF THE INVENTION

Figures 1, 2:
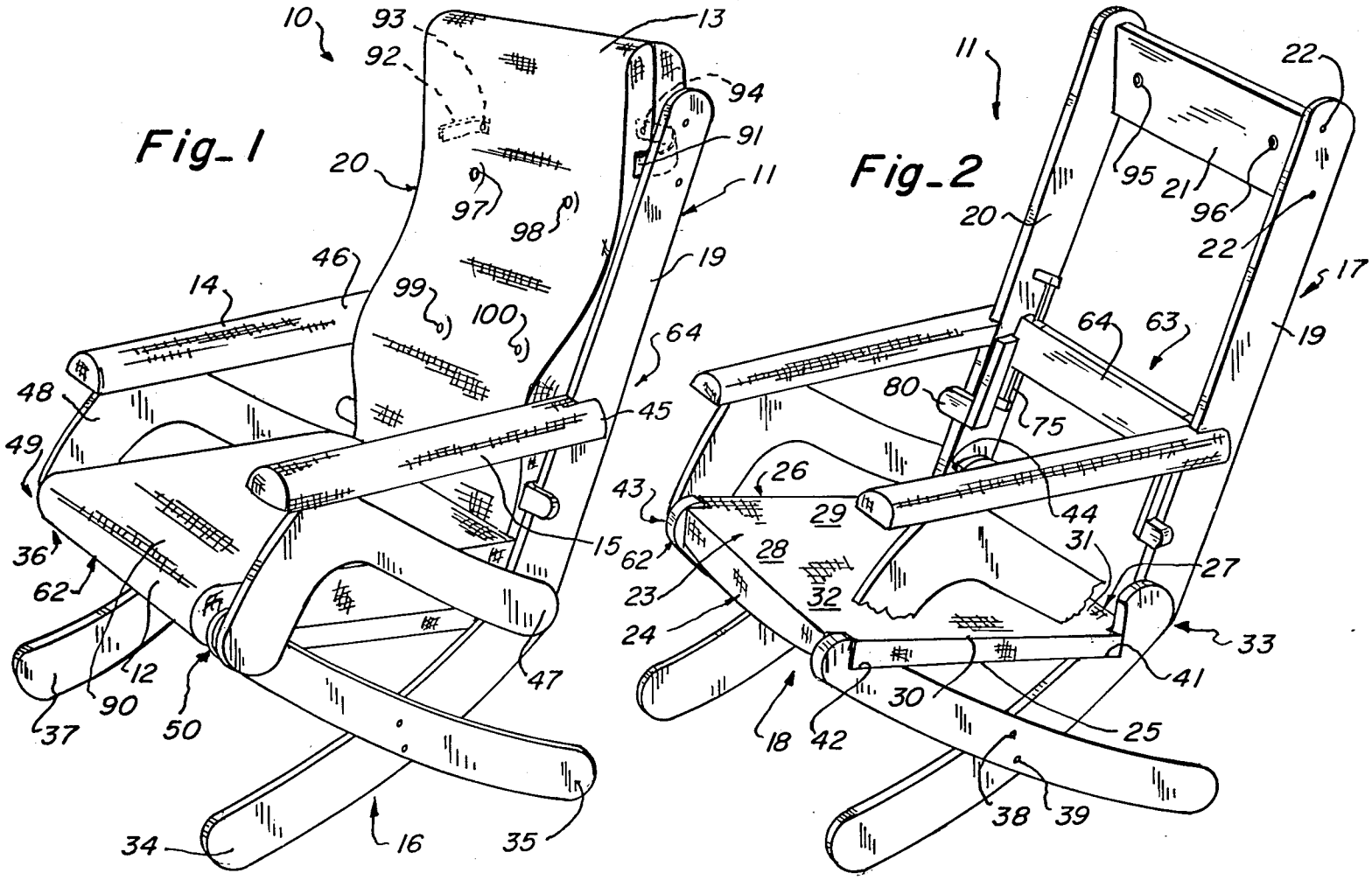
FIG. 1 is a front perspective view of a seating device in accordance with this invention.
FIG. 2 is a front perspective view of the seating device in accordance with this invention and from which the cushion portions of the seating device have been removed.

Referring now to the drawings, a seating device 10 is shown in FIG. 1 having a framework 11, cushions 12 and 13, armrests 14 and 15 and reference surface engaging portion 16.

As shown more clearly in FIG. 2, framework 11 is comprised of backrest framework section 17 and seat framework section 18. Backrest section 17 is formed by spaced framework members 19 and 20 and neck and shoulder supporting member 21 residing between framework members 19 and 20 and maintained by screws 22. It should be understood that attachments, such as that just described, while referring to only one side of the seating device have like attachments on the opposite side of the seating device. Neck and shoulder supporting member 21 is attached between the backrest framework members 19 and 20 so as to be substantially perpendicular to seat framework section 18.

Seat framework section 18 is formed by plywood sheet 23 mounted by wood screws (not shown) to seat framework members 24, 25, 26 and 27. Shims 28, 29, 30 and 31 are provided on the top edges of the plywood sheet 23 to effect raising of the edges. Upholstering material 32 then covers the entire surface of plywood sheet 23 and framework members 24, 25, 26 and 27, and is attached at the bottom of seat framework section 18 with, for example, staples.

Backrest section 17 and seat section 18 are attached at an angle of approximately 105° to 110°. Seat section 18 is shorter than back section 17, being approximately 14 inches deep, and is not horizontally disposed, but is angled slightly downward to the back edge 33, thereof.

Figure 3:
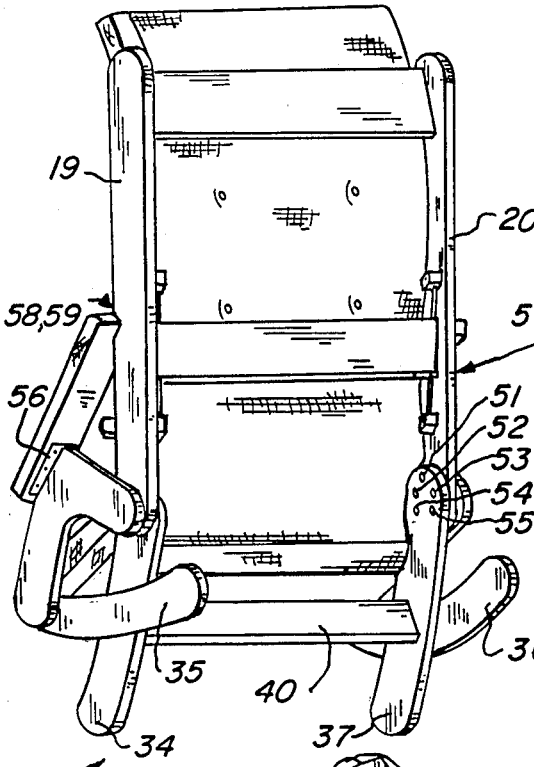
FIG. 3 is a perspective view from behind and below the seating device.

As seen more clearly in FIG. 3, reference surface engaging portion 16 is formed by legs 34, 35, 36 and 37. As shown in FIG. 2, legs 34 and 35 are fastened together at their middle portions by screws 38 and 39, legs 36 and 37 being fastened together in like fashion. Turning back to FIG. 3, screws 38 and 39, and the corresponding screws on legs 36 and 37, also serve to connect bottom brace 40 between legs 34 and 35 and legs 36 and 37. One end of legs 34, 35, 36 and 37 are fastened through plywood sheet 23 by screws (not shown) at notched portions 41, 42, 43 and 44 (as shown in FIG. 2), while the other end of each leg is engageable with a reference surface, such as a floor.

Referring back to FIG. 1, armrests 14 and 15 are provided and are formed by arms 45 and 46 and curved arm supports 47 and 48. Arm supports 47 and 48 are connected at their forward portion to the top portion of legs 36 and 36 by screws 49 and 50 respectively, and at their rear portion to backrest framework members 19 and 20 and legs 34 and 37 by five screws on each side (for example, FIG. 3 screws 51, 52, 53, 54 and 55). As best viewed in FIG. 3, arms 45 and 46 are connected to the arm supports at the uppermost curve thereof by fastening means 56 and 57. Arms 45 and 46 are connected to backrest framework members 19 and 20 by screws 58, 59, 60 and 61 (not shown) at a position approximately twelve and a half inches above plywood sheet 23. As shown in FIG. 2, arms 45 and 46 rise above front edge 62 of plywood sheet 23 a distance of approximately nine and a half inches.

Figure 4:
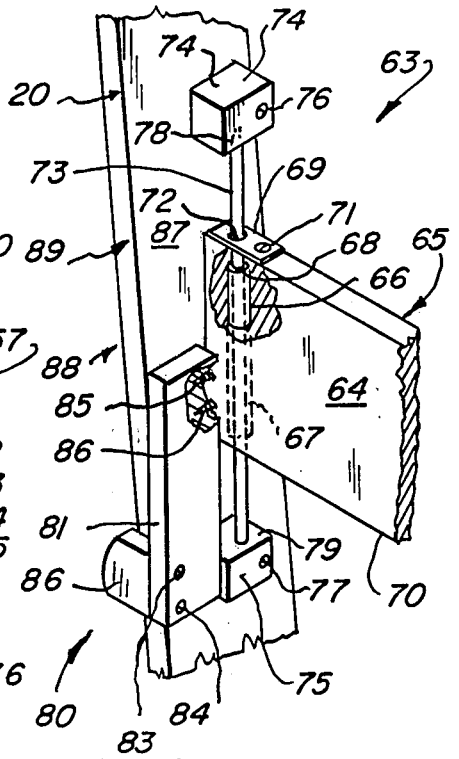
FIG. 4 is a perspective view of the lumbar supporting portion of the seating device, and with a portion thereof cut away to better illustrate the mounting and adjustment mechanisms therein.

As seen in FIG. 2, lumbar supporting means 63 resides between backrest framework members 19 and 20. Turning now to FIG. 4, lumbar supporting means 63, one side of which is shown, it being understood that the opposite side presents a mirror image of those features hereinafter described, has a flat lumbar support surface 64 which is approximately four inches in width. Surface 64 is formed by supporting member 65. Supporting member 65 has a passage 66 described through the member at its end and paralleled to surface 64 and into which fiber or plastic sleeve 67 us snugly fitted. Passage 66 has approximately the same outside diameter as sleeve 67 through most of its length, but being smaller at its lower end so that the sleeves may not pass entirely through support member 65. Sleeve 67 has a passage 68 therethrough. Passage 66 has retainer 69 mounted over it on upper surface 70 of support member 65, retained there by screw 71.

Retainer 69 has a hole 72 equal in size to the inside diameter of sleeve passage 68 therethrough so that when mounted, retainer 69 covers and retains sleeve 67 within supporting member 65 but maintains, unobstructed, passage 68.

Guide rod 73 is then mounted through the hole in retainer 69 and through sleeve 67 at passage 68. Guide rod 73 is maintained within sleeve in such a fashion that when adjustment of lumbar support surface 64 is made by a user of the seating assembly the sleeve will maintain the rod in its position, but not so firmly as to make further adjustment difficult for a user. Guide rod 73 is approximately eight inches long and is, in turn, mounted by mounting blocks 74 and 74 to backrest framework members 20. Mounting blocks 74 and 75 are maintained on backrest support member 20 by screws 76 and 77, guide rod 73 being maintained between the mounting blocks in indentions 78 and 79 within the mounting blocks.

Still with reference to FIG. 4, handle means 80, formed by mounting member 81 and grip 82, connected by screws 83 and 84, are mounted to lumbar support surface 64 by screws 85 and 86. Handle mounting member 81 is mounted in such a way as to be disposed in a parallel fashion to the inside surface 87 of backrest framework member 20, and grip 82 is mounted to the mounting member 81 in such a fashion as to extend beyond the outer surface 88 of back support members 20 thereby being accessible to a user of the seating device while the user is seated therein.

As shown in FIG. 2, lumbar supporting means 63 is mounted on backrest framework members 19 and 20 so that the bottom of the lower set of guide rod mounting blocks (75 in FIG. 4) are approximately seven inches above plywood sheet 23. As seen in FIG. 4, the lower mounting block 75 is mounted nearer the front edge 89 of the backrest framework member 20 than is the top mounting block 74 so that, as shown in FIG. 2, lumbar support surface 64 resides at an angle more obtuse with respect to seat framework section 18 than does the backrest framework section 17.

By manipulation of the handle means (80 in FIGS. 2 and 4), a person seated in the seating assmebly may adjust the lumbar support surface 64 toward and away from seat framework section 18.

As seen more clearly in FIG. 1, seat cushion 12 is maintained on seat framework section 18. Cushion 12 is formed, for example, of foam padding (not shown) retained within cover 90 for which most upholstering materials would be suitable. Seat cushion 12 extends beyond the front edge 62 of seat framework section 18 so as to provide a padded surface thereon and, therefore, provides more comfort to the underside of the thigh of one seated in the seating device. Shims 29 and 30 (shown in FIG. 2) in turn cause seat cushion 12 to be slightly raised on the outer edges thereof thereby giving lateral support to the thighs and buttocks of one seated in the seating device.

Backrest cushion 13, formed of materials similar to seat cushion 12, is provided, as shown in FIG. 1, and is maintained on backrest framework section 27 by straps 91 and 92, stitched to cushion 13 which straps are fitted with female snap members 93 and 94. Female snap members 93 and 94 have corresponding male snap members 95 and 96 (shown in FIG. 2) mounted on backrest framework section 17. By selective placement of female snap members 93 and 94 upon straps 91 and 92, the placement of cushion 13 within backrest framework section 17 may be made adjustable to users of different height.

In FIG. 1 it is seen that cushion 13 is indented, as for example by tufting, at 97, 98, 99 and 100. Indented sections 97 and 98 are maintained, when cushion 13 is properly adjusted by proper placement of female snap members 93 and 94, at a position in conjunction with the shoulder blades of a user.

Cushioning 13 extends slightly above neck and shoulder supporting member 21 (shown in FIG. 2) so that when lumbar support surface 64 is properly adjusted, the cushion 13, under the influence of a user, is depressed slightly inwardly between the lumbar support surface and neck and shoulder supporting member thereby causing a slight, corresponding, forward thrust at the top of cushion 13, the effect of which is to accomodate the natural curvature of the spine.

Figure 5:
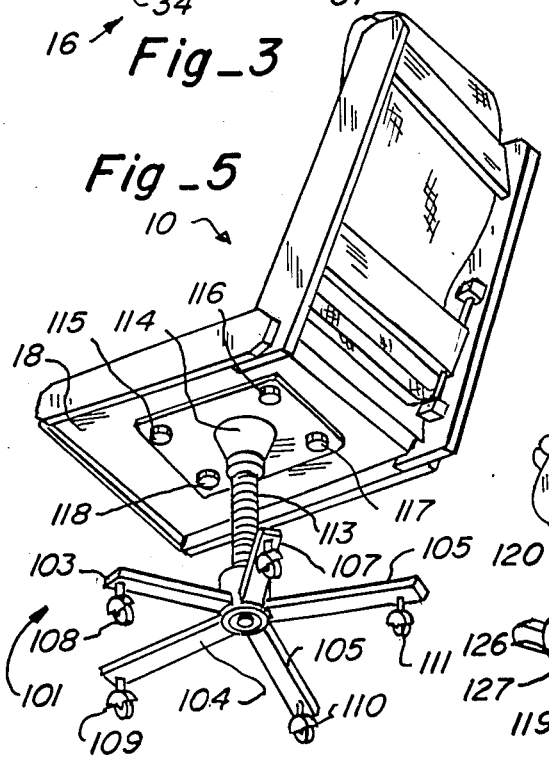
FIG. 5 is a perspective view of one alternative embodiment of the seating device in accordance with this invention.

As shown in FIG. 5, an alternative embodiment of seating device 10 is shown which is in most regards similar to the embodiment set out hereinabove but which employs no armrests and has a different reference surface engaging portion 101 comprising hub 102 from which wheel support arms 103 through 107 extend. Mounted on the support members are casters 108 through 112. Hub 102 is attached to threaded height adjusting post 113 which is in turn connected at its opposite end to pivot 114. Pivot 114 is mounted to seat framework section 18 by screws 106, 106, 107 and 108, thereby allowing rotation of seat section framework 18 upon reference surface engaging portion 101 as well as easy movement of the seating device over a reference surface.

Figure 6:
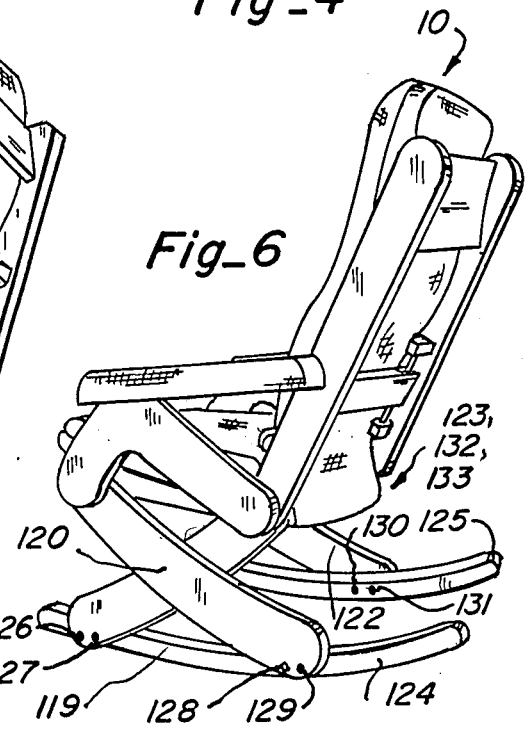
FIG. 6 is a perspective view of another alternative embodiment of the seating device in accordance with this invention.

As shown more clearly in FIG. 6, another embodiment of seating device 10 is shown which is different only in that it employs reference surface engaging portion 119 which is configured to allow a rocking motion. The reference surface engaging section 119 is comprised of legs 120, 121, 122 and 123, and rockers 124 and 125, connected to the bottom of the legs by screws 126 through 133.

Neck and shoulder supporting member 21 is preferably made of dimensional lumber, for example, one inch by six inch oak. Backrest framework members 19 and 20 are likewise made of one inch dimensional lumber, for example, one inch by four inch oak, and lumbar supporting member 65 in a like fashion may be made of one by four dimensional lumber. The retainers 69, and its corresponding member not shown herein, and guide rods 73 and its corresponding rod, may be made of brass or other durable metal material. All dimensions set out herein may of course be adjusted as required for proper adjustment to a particular user.

As can be appreciated from the foregoing, this invention provides an improved seating device which is constructed for course adaptability to users, with fine adaptabliity being made by the user by adjustment while seated in the device.

What is claimed is:

1. A body adaptable seating device, comprising:

a frame having a seat section, an open back framework formed by a pair of side members that are substantially parallel to one another and spaced from one another substantially the width of said seat section, and an upper supporting member extending between and at an angle with respect to said side members at the top portions thereof, said seat section having a rear portion and each of said side members having a lower portion connected with said rear portion of said seat section with said open back framework extending upwardly and at an obtuse angle from said seat section and with said upper supporting member being at an angle with respect to said seat section that is less than that formed by said seat section and said open back framework;

first and second pairs of mounting means each pair of which is located on a different one of said side members;

first and second substantially rigid guide members the opposite end portions of which are mounted at different ones of said pairs of mounting means on said side members so that the central portions of said guide members extend along and adjacent to an associated one of said side members with said central portions of said guide members being substantially parallel to one another and extending at an obtuse angle with respect to said seat section that is greater than said obtuse angle formed by said open back framework and said seat section;

lower back support means mounted on said central portions of said guide members so that said support means is movable along and with respect to said central portions of said guide members, said lower back support means being positioned between said side members within the otherwise open back area provided by said open back framework formed between said side members and below and spaced from said upper supporting member to provide a lower back support surface thereat, with said support means having a support surface that is substantially parallel to said central portions of said guide members for providing lower back support to a substantial number of the vertebrae in the lumbar region of the spine of a user when properly seated in said seating device;

handle means on said support means to facilitate movement of said support means along said central portions of said guide members; and cushion means positioned at said frame to at least substantially span said open back framework with said cushion means extending between said seat section to and beyond said upper supporting member so that said cushion means is positioned between said support means and a user when said user is properly seated in said seating device whereby lower back support is provided to such a user by said support means and such a user can displace said cushion means in a direction away from said user at the area of said cushion means between said upper supporting member and said support means to thereby facilitate contouring of said cushion means to better support the body of said user seated in said seating device.

2. The seating device of claim 1 wherein said open back framework extends from said seat section a distance greater than does said seat section from said backrest section.

3. The seating device of claim 1 wherein armrest portions are provided at said frame, said armrest portions being placed so that the shoulders of a person properly seated in said device are not raised by placement of the arms on the armrest portions, and which armrest portions are pitched slightly downwardly in relation to said seat section.

4. The seating device of claim 1 wherein said cushion means is provided with adjustment means to raise and lower said cushion means with said framework, and wherein said cushion means has tufted areas so that when said cushion means are properly adjusted, said tufted areas are located at the shoulder blades of a person when properly seated in said device.

* * * * *